US005142961A

United States Patent [19]

Paroutaud

[11] Patent Number: 5,142,961

[45] Date of Patent: Sep. 1, 1992

[54] METHOD AND APPARATUS FOR STIMULATION OF ACOUSTIC MUSICAL INSTRUMENTS

[76] Inventor: Fred Paroutaud, 1316 Barry Ave. #9, Los Angeles, Calif. 90025

[21] Appl. No.: 433,652

[22] Filed: Nov. 7, 1989

[51] Int. Cl.[5] ..... G10H 3/18; G10H 7/00; G10H 3/14; G10H 3/00

[52] U.S. Cl. ..... 84/726; 84/645; 84/725; 84/743; 84/2; 84/3; 84/738

[58] Field of Search ..... 84/2, 3, 9, 11, 83, 84/170, 171, 172, 115, 462, 601-603, 609, 645, 634, 639-643, 742, 743, 723, 725, 726

[56] References Cited

U.S. PATENT DOCUMENTS

| | | | |
|---|---|---|---|
| 1,594,477 | 8/1926 | Smith | 84/2 |
| 1,688,450 | 10/1928 | Corbett | 84/2 |
| 1,739,799 | 12/1929 | Mills | 84/2 |
| 3,666,875 | 5/1972 | Ranzako . | |
| 3,823,245 | 7/1974 | Suzuki | 84/600 |
| 4,075,921 | 2/1978 | Heet | 84/738 |
| 4,469,000 | 9/1984 | Fujiwara et al. | 84/115 |
| 4,681,008 | 6/1987 | Morikawa et al. | 84/603 |
| 4,704,931 | 11/1987 | Nagai et al. | 84/172 |
| 4,744,281 | 5/1988 | Isozaki | 84/171 X |
| 4,941,388 | 7/1990 | Hoover et al. | 84/726 |

*Primary Examiner*—William M. Shoop, Jr.
*Assistant Examiner*—Jeffrey W. Donels
*Attorney, Agent, or Firm*—Hecker & Harriman

[57] ABSTRACT

Method for storage, transcription, manipulation and reproduction of music on system-controlled musical instruments which faithfully reproduces the characteristics of acoustic musical instruments. The system comprises a music source, a Central Processing Unit (CPU) and a CPU-controlled plurality of instrument transducers in the form of any number of acoustic or acoustic hybrid instruments. In one embodiment, performance information is sent from a music source MIDI controller to the CPU, edited in the CPU, converted into an electrical signal, and sent to instrument transducers via transducer drivers. In another embodiment, individual performances stored in a digital or sound tape medium are reproduced at will through the instrument transducers, or converted into MIDI data by pitch/frequency detection/analyzation device for storage/editing/performance in the CPU. In still another embodiment, performance information is extracted from an electronic recording medium or live performance by a pitch/frequency detection/device, edited in the CPU, converted into an electrical signal, and sent to any number of instrument transducers. The device also eliminates acoustic musical instrument delay problems.

22 Claims, 9 Drawing Sheets

FIG. 5(a)
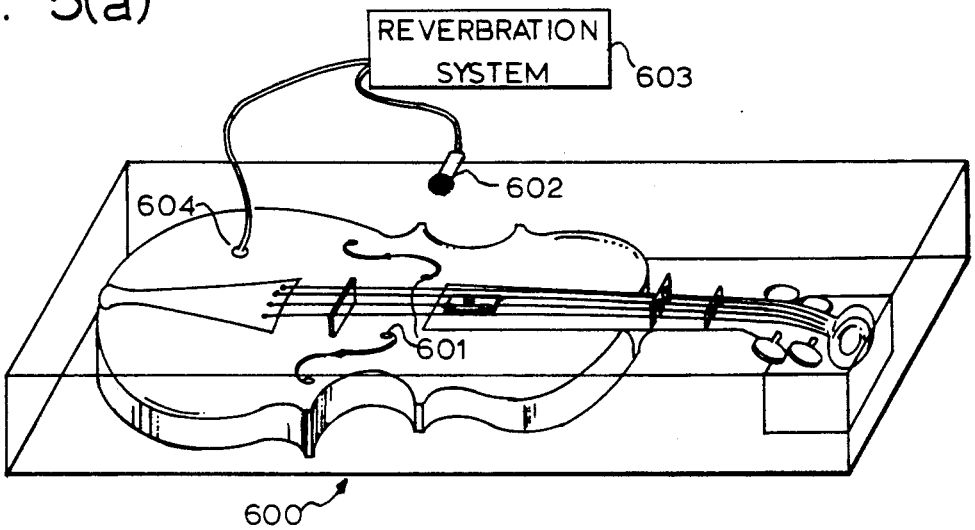
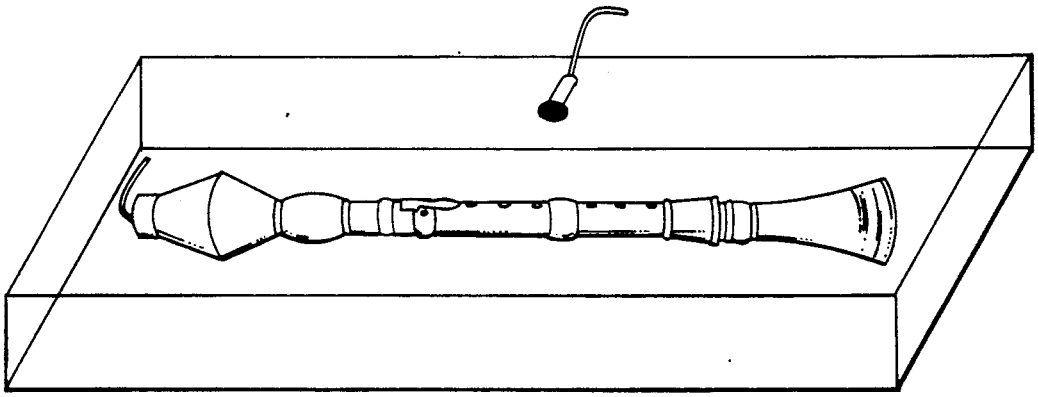
FIG. 5(b)
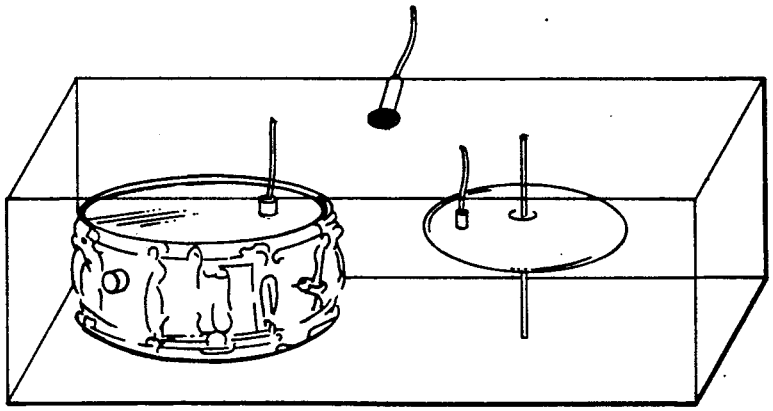
FIG. 5(c)

AS A COMPOSITION / PERFORMANCE TOOL

AS A MUSIC TRANSCRIBER

METHOD AND APPARATUS FOR STIMULATION OF ACOUSTIC MUSICAL INSTRUMENTS

BACKGROUND OF THE PRESENT INVENTION

1. Field of the Invention

The present invention relates to systems of electromagnetic or electromechanical stimulation of acoustic musical instruments for the purpose of high fidelity production or reproduction of music.

2. Background Art

Acoustic instruments (i.e., non-electrical instruments) are the instruments of choice for performing most musical pieces. Acoustic instruments typically excite a moveable element near an air chamber to produce sounds. For example, in a violin, guitar or piano, strings are manipulated, excited and amplified by a sound chamber to produce sound; in a clarinet, oboe or saxophone, a reed is excited like a valve, and regulates a moving column of air down the bore of the instrument to produce sounds; in drums, a tightly-stretched membrane is excited and amplified by the drum body to produce sounds.

In the creation of recorded music, it is often desired to utilize acoustic instruments as part of the recorded performance. However, this often limits the repeatability of performances for recording and limits the venues where recording sessions can take place. For example, since acoustic instruments are recorded through the air, the acoustics of the recording locations are critical. This often prevents the use of a live acoustic performer when the recording is to be done at a small studio or a home environment. Further, if a large number of acoustic instruments are desired, the expense and logistics of supporting a large number of live performers is typically prohibitive. One prior art attempt to solve the problem of providing acoustic sounds for recording purposes is to substitute electronically-produced sounds such as from a synthesizer, sampler or the like. While such efforts can provide solutions to the problem of repeatability of performance, venues of recording sessions and expense, these prior art attempts do not provide satisfactory solutions to the problems of sound fidelity and authenticity. Synthesizers do not recreate strings or other acoustic instruments effectively, sounding artificial and lacking the richness and variety of live performers. High fidelity sampling techniques are expensive in terms of dollars and memory requirements, and also fall short of the real thing in terms of flexibility and acoustic authenticity.

There are methods in existence between the extremes of reproduction and live performance. The player piano, for example, is a device which can reproduce music on a real piano without the need for a human pianist. The player piano affords a composer with the convenience of storage and playback capability. Obviously though, the sounds producible by a piano cannot encompass other instruments such as strings or winds. Prior art player pianos are described in U.S. Pat. Nos. 4,843,936; 4,756,223; 4,744,281; 4,593,592; 4,469,000; 4,417,494 and 4,383,464.

Attempts have been made to record and reproduce a player piano musical performance synchronized with an orchestral recording. This complex mechanical reproduction, while a faithful reproduction of a piano, makes no attempt to faithfully reproduce other instrument groups, relying on the traditional loudspeaker for that purpose.

Presently, music is performed either acoustically or electronically or in combination, recorded through an electronic mixing board onto digital or sound tape and replayed electromagnetically through fiber speaker cones. Rarely, music is performed on a player piano, performance data being stored digitally, then replayed by a player piano mechanically reproducing the piano's real sound. In the case of electronic recordings, fidelity is lost during each step of the process. Even during the initial performance of the acoustic instruments, noise and distortion are introduced. Using the player piano method, an acoustic performance is reproduced mechanically with hammers and pedals, but only a piano is reproduced, mechanical delay is introduced and flexibility is lacking.

Therefore, it is an object of the present invention to provide a method and apparatus for electronically producing and reproducing the sounds of both individual and groups of acoustic and acoustic hybrid instruments.

It is another object of the present invention to provide means for electronically and mechanically stimulating musical instruments in an electronically controlled and repeatable manner.

It is yet another object of the present invention to provide a method and apparatus for stimulating a plurality of acoustic instruments from a single system.

It is still another object of the present invention to provide a method and apparatus for stimulating acoustic instruments such that a "live" performance can be generated in a repeatable and controllable manner.

It is another object of this invention to provide a computer-controlled music creation system for acoustic musical instruments to create and store performances and recordings.

It is another object of this invention to provide computer control of acoustic musical instruments.

It is another object of this invention to provide computer control of electromagnetically-stimulated transducers.

It is still another object of this invention to provide piano-like keyboard or any other method of control of acoustic and acoustic hybrid instruments.

It is still another object of this invention to provide storage and editing control of an acoustic or acoustic hybrid music performance.

It is still another object of this invention to provide a method of reproducing a live acoustic musical performance.

It is still another object of this invention to provide a method of extracting performance information from a live or prerecorded musical performance with an automatic pitch/frequency detection/analyzation device for use, storage and editing in an instrument transducer controlling CPU.

It is another object of the present invention to provide a method of synchronizing a performance of controlled acoustic instruments with a video image.

It is yet another object of the present invention to provide a method and apparatus for eliminating mechanical delay from CPU-controlled acoustic musical instruments.

SUMMARY OF THE INVENTION

This invention is an innovative system that creates, manipulates, mixes and recreates acoustic and acoustic hybrid musical instrument sounds and performances which are completely faithful to source instrument sounds and performances. This invention also provides a method of creating, manipulating, mixing and recording new and novel musical sounds.

As in the traditional orchestra, metal strings attached to sounding boxes, air columns within wooden or metal cylinders (straight or conical), membranes (drum skins), and pieces of metal, wood and plastic are relied on as sound sources and transducers. These instrument transducers are in turn precisely stimulated by computer-controlled electromagnetic, electromechanical and/or other devices (air pump, bow damper, etc.) to create and recreate both the authentic and rich traditional orchestral instrumental sounds as well as novel synthesized or hybrid sounds.

Each performance is controlled, edited, stored and recreated via a computer and recording medium. There is no fidelity loss and no noise or distortion is introduced at any time since the sounds are emanating from the instrument transducers themselves, not electronic devices and fiber loudspeakers. All the instruments of an orchestra or group can be faithfully reproduced.

Various types of instrument transducers are employed. Taut wires are vibrated inside electromagnetic coils and amplified and modified by a wooden chamber (creating string sounds such as violin, viola, guitar, cello, bass, etc.). Air columns inside wooden or metal cylinders as well as the wooden or metal cylinder are oscillated with an electromagnetic reed in conjunction with an air supply (creating "woody" sounds such as oboe, clarinet, bassoon, etc., and metallic sounds such as the saxophone). Air columns inside a metal cylinder as well as the metal cylinder are oscillated with an electromagnetic embouchure in conjunction with an air supply (creating metallic sounds such as piccolo, flute, trumpet, french horn, trombone, tuba, organ, etc.). Stretched membranes are vibrated by an attached electromagnetic coil and amplified and modified by a wooden or metallic chamber (creating membrane sounds like snare drum, bass drum, timpani, tom-toms, congas, etc.). Pieces of wood, metal or plastic are vibrated by an attached electromagnetic coil (creating percussive sounds such as xylophone, triangle, glockenspiel, etc.). The air column within an artificial larynx is oscillated by an electromagnetic vocal cord in conjunction with an air supply (creating female voices, male voices, etc.).

In the preferred embodiment of the present invention, the output and/or performance information of an acoustic or electronic instrument is recorded and stored. The stored data is converted to MIDI (Musical Instrument Digital Interface) format and is used to drive an electromagnetic or electromechanical transducer of an acoustic instrument and/or a synthesizer/sampler. Performance information from a MIDI keyboard or other controller is combined with the stored performance data to create a new performance independent of the stored data or to modify the stored data. A CPU is used to edit and create sequences to provide output to drive the electromagnetic transducers. Alternatively, the original performance data can be provided from a recording or live performance of instruments.

BRIEF DESCRIPTION OF THE DRAWINGS

FIGS. 5(*a*) through 5(*c*) are illustrations of rack mountable acoustic instrument transducers.

DETAILED DESCRIPTION OF THE PRESENT INVENTION

Figure 1:
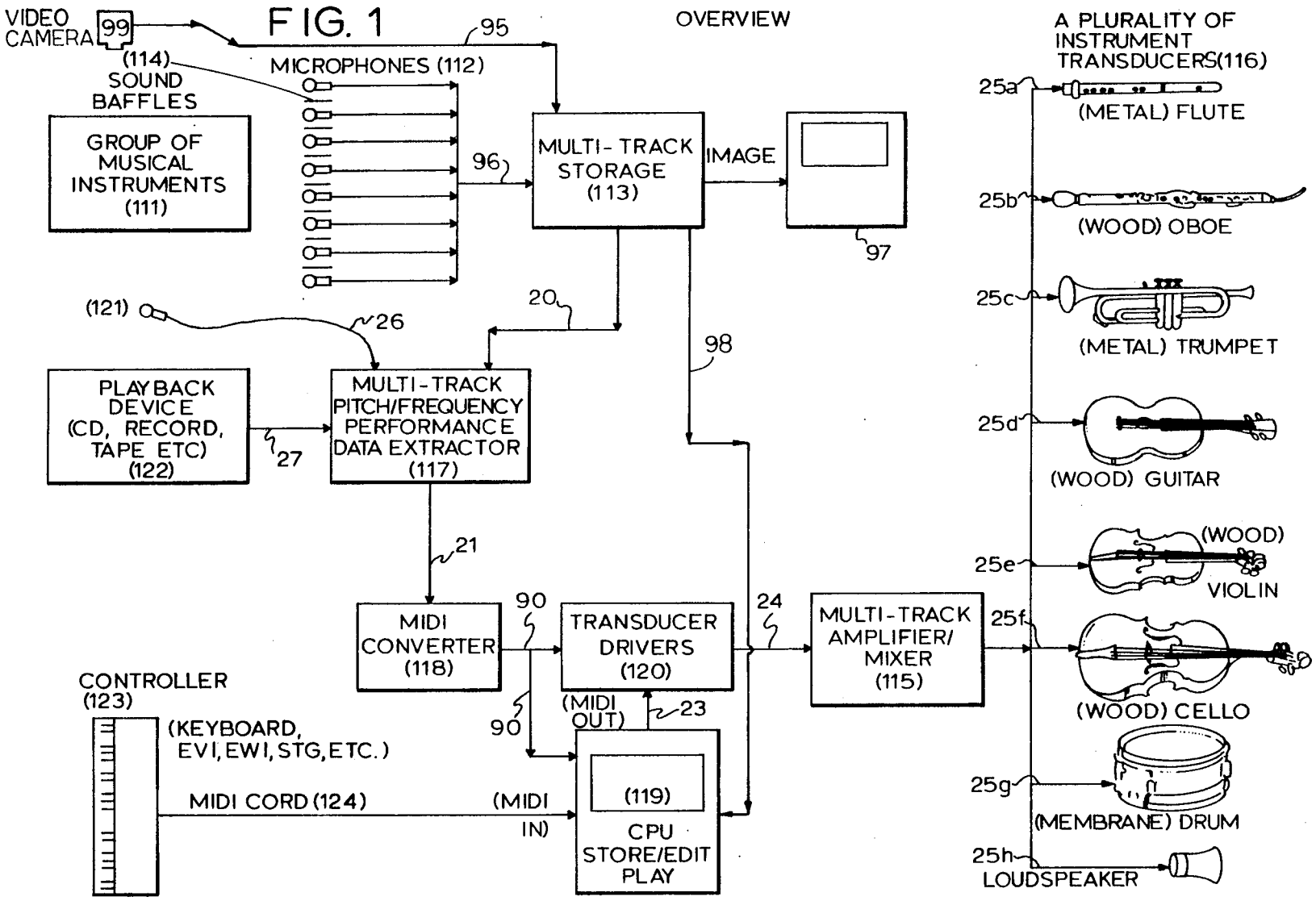
FIG. 1 is an overview block diagram of the present invention.

A musical production system consisting of creating, recording, processing and reproduction means is described. In the following description, numerous specific details are set forth in order to provide a more thorough understanding of the present invention. It will be apparent, however, to one skilled in the art, that the present invention may be practiced without these specific details. In other instances, well-known features have not been described in detail in order not to unnecessarily obscure the present invention.

The present invention is a system which accepts as input music from a source. That source can either be a plurality of acoustic and/or electrical musical instruments, a playback device such as a compact disk or magnetic tape player, or other sound sources which can be recorded by microphones. Data from such live or recorded sources is converted into MIDI format. There also exist instruments which can serve as source music suppliers whose performance data does not require conversion, because their output is preformatted to MIDI configuration. A signal in MIDI format can then be processed by a central processing unit (CPU), a computer which provides editing capabilities for the system. The CPU can transfigure signals to create diverse and interesting effects. Output of the CPU is also in the MIDI format.

In the description of the present invention, there are references to sound signal being converted to MIDI format. It will be understood that any format similar to MIDI may be used. In addition, any other suitable format for signals may be utilized without departing from the scope and spirit of the present invention.

Transducer drivers and other electric devices coupled to acoustic instruments deconvert the MIDI signals to the component parts which are necessary to drive the various instrument transducers that serve as output devices. The input to the transducer drivers can either be directly from a MIDI converter for live or recorded signals, or from a controller which has as output a MIDI-formatted signal. From the transducer drivers, some extracted and separated signals pass through a multi-track amplifier and mixer which in turn drives each instrument transducer with the appropriate extracted signal, while other MIDI signals control other electric devices such as electromagnets, air pumps and electronic instruments.

Because actual acoustic musical instruments are driven by the MIDI signal, a "live" acoustic sound is created. The transducers and other devices of the respective acoustic instruments are excited by a MIDI signal in a way which faithfully recreates the playing of the instruments by a live performer. For example, a violin string is excited by a bow moved back and forth on the strings by a performer. The pitch of the vibrating string is adjusted by changing the length of the string such as when the performer presses the string against various points of the neck of the violin. The vibration of the strings excites the air in the air chamber created by the body of the violin to produce the violin's sound.

In the present invention, the strings are excited by electromagnetic transducers and made to vibrate much as if a bow was being moved across the strings. The pitch of the strings can be changed electronically by altering the MIDI signal pitch used to excite the strings as well as the length of the string. The present invention not only allows for realistic recreation of traditional acoustic musical instrument or string sounds, but also allows new sounds to be created. For example, on a traditional violin, the strings are in an inverted V configuration so that it is impossible for the bow to touch all of the strings at once, particularly the first and last strings. However, by electronically exciting the strings individually, any combination of the strings may be excited with corresponding new sounds created. Also, by electronically exciting a violin string with the sound pattern of a clarinet, a novel acoustic hybrid sound is created. In the present invention, the instrument transducers (e.g., strings of a violin, reed of a clarinet, diaphragm of a drum) are also referred to as "primary" transducers. The electromagnetic or electromechanical transducers are referred to as "secondary" transducers. The secondary transducer is used to excite the primary transducer to create the desired sounds.

FIG. 1 is an overview block diagram of one possible embodiment of the present invention. In FIG. 1, the music source is a group of musical instruments at 111, for example, an orchestra or a rock group. Microphones 112 detect the sound of each instrument in the musical performance (electric guitar, violin, bass, trumpet, soprano saxophone, snare drum and cymbal, for example) and record each instrument onto a separate channel of multi-track storage/synchronization block 113. Sound separation of each instrument is accomplished with a combination of careful microphone placement, sound baffle 114 placement, and even room separation, if necessary. Because of the nature of this invention, strict group isolation is not required. Some leakage may be desirable as this effect is faithful to acoustic principals.

The recorded signal 20 in multi-track storage 113 is coupled to data extractor 117. Image data can also be provided from storage 113 to a video display 97 via line 96. Data extractor 117 is a multi-track pitch/frequency/performance data extractor. The output 21 of multi-track data extractor 117 is coupled to MIDI converter 118. The output 22 of MIDI converter 118 is coupled to transducer drivers 120. The output 22 of MIDI converter 118 is also coupled to CPU 119. CPU 119 provides an output 23 to transducer drivers 120. The output 24 of transducer drivers 120 is coupled to multi-track amplifier/mixer 115. Amplifier/mixer 115 provides a plurality of outputs 25(*a*)–25(*h*) to drive the instrument transducers 116 of the various acoustic instruments. CPU 119 can be used to edit or manipulate the digital MIDI format data.

Referring again to FIG. 1, video synching of electronically-controlled acoustic instruments to a taped performance can be achieved with the present invention. The music source (group of musical instruments 111) is recorded "live." The performance is simultaneously recorded with the video camera 99 and the output 95 of the video camera is provided to multi-track storage 113. Multi-track storage/synchronization block 113 includes devices such as a multi-track audio recorder/reproducer synchronized to a video recorder/reproducer. The sound output, as described above, is provided to CPU 119. Video synchronization is provided on SMPTE synch cord 98 to the CPU to synchronize the video or other image reproducing or recording information with the audio output. The synchronized image signal derived from the storage block 113 is reproduced as a screen image on a CRT 97 via line 96 and is synchronized with the performances of the electronically-controlled acoustic instruments. It should be noted that the SMPTE synch cord 98 is not required when the instruments are driven directly from MIDI converter 118, the storage synchronization block 113 provides appropriate synchronization. Only when audio data is edited in CPU 119, is SMPTE cord 98 required.

The CPU 119 may be any general purpose computer or personal computer such as are available today. For example, a Macintosh computer manufactured by Apple Computer, Inc., may be used in the present invention. In addition, a number of commercially-available programs for editing and manipulating musical sequences may be advantageously used with the present invention. By way of example, a program such as "Performer" by Mark of the Unicorn, is suitable for use in manipulating and editing the MIDI signals provided by MIDI converter 118 or controller 123.

It will be understood that the present invention may be practiced without the use of the CPU. The output of the controller can be coupled directly to the transducer drivers. Similarly, the output of MIDI converter can be directly coupled to the transducer drivers to drive the secondary transducers of the individual acoustic instruments.

Another method of musical performance digital extraction is possible. Musical instruments 111 can be patched directly to performance data extractor 117 with a single microphone 121 via line 26, or another playback device 122 (electric audio player, CD, tape, etc.) via line 27. From there, the signal connector via line 21 connects to MIDI converter 118 and on to CPU 119 via line 22 where it can be stored or edited in a digital (MIDI) format, and then played through line 23 to transducer drivers 120, line 24 to multi-track amplifier/mixer 115, and instrument transducers 116 via lines 25 for faithful reproduction of the acoustic and electronic instrument sounds.

Another method of musical performance digital extraction is available. Performance on controller 123 can be directly routed to CPU 119 using MIDI cord 124. Digital performance information in CPU 119 can be stored, edited and played via line 23 through transducer drivers 120, multi-track amplifier/mixer 115 via line 24, and instrument transducers 116 via lines 25 for faithful creation of acoustic instrument sounds. The output 124 of controller 123 can also be directly coupled to transducer drivers 120. The output 124 of controller 123 can be coupled directly to the transducer drivers through the CPU by creating an electronic link without any modification of the signal by the CPU. Alternatively, a separate connection directly to the transducer drivers may be implemented. Either system can be utilized without departing from the scope and spirit of the present invention.

Figure 2:
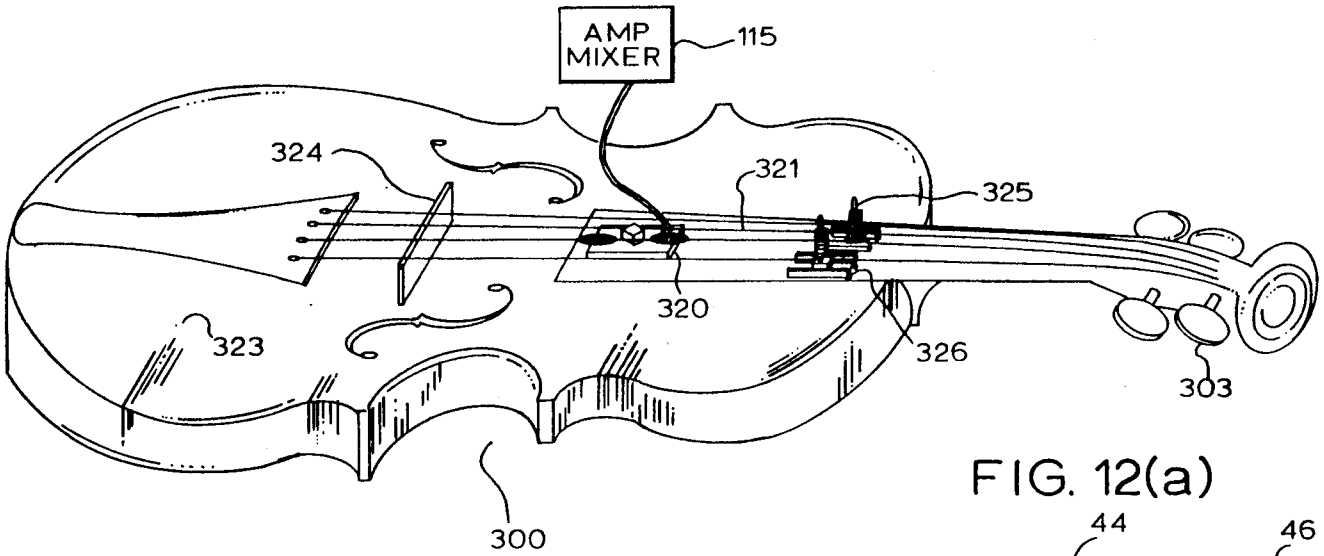
FIG. 2 is an illustration of a typical string instrument transducer assembly.

FIG. 2 is an illustration of a string instrument transducer assembly, in this case violin 300. The violin 300 consists of a main body portion 323 and an extended neck portion 322. The body 323 is typically comprised of wood and is hollow. A plurality of strings 321 are coupled to the violin body and extend over a bridge 324 mounted on the upper surface of body 323. The strings extend along the neck 322 to tighteners 303. The tighteners are screws or the like used to draw the strings taut and to "tune" the violin. When the strings are excited, the air within the body 323 vibrates and produces sound waves and ultimately the sound of the violin.

In the present invention, the strings are metallic and can be excited by an electromagnetic field. An electric coil/magnet assembly 320 energizes a selected metallic string 321 sympathetically with the incoming signal from amplifier/mixer 115. The incoming signal can either be a digitally-stored sample or a synthetic signal produced by a synthesizer. This energy vibrates the selected string 321, with the vibration being transferred to hollow wooden violin body 323 through wooden bridge 324. This action sets the entire violin 300 into an acoustic vibration distinctive to the violin. An adjustable string damper 325 interacts with the vibrating string 321, recreating the authentic violin sound. Violin string 321 works best when its length and tension matches or is a harmonic or "overtone" equivalent of the incoming signal from amplifier/mixer 115. A plurality of strings are desirable for a variety of sympathetic pitches.

Figure 10:
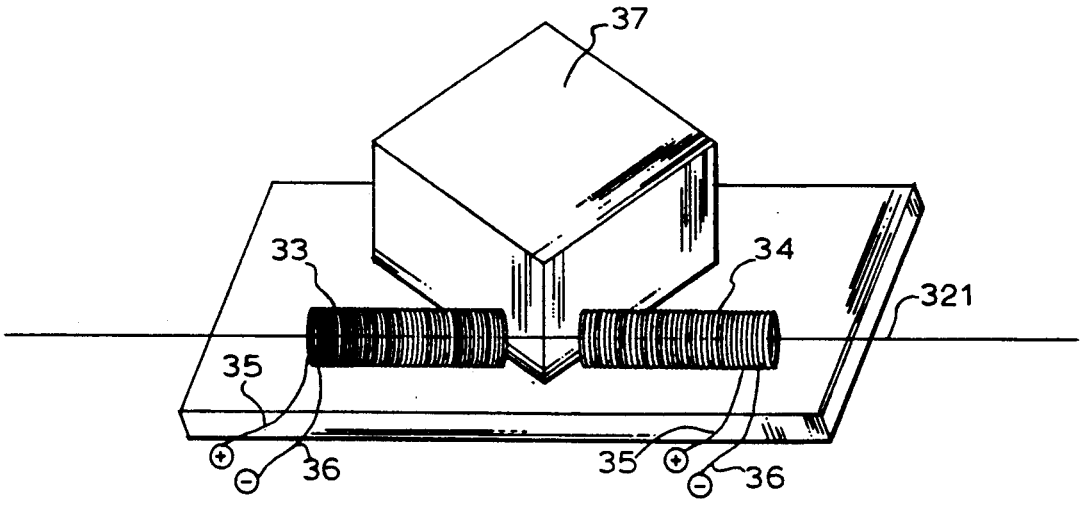
FIG. 10 illustrates the magnet/coil assembly of FIG. 2.

The coil magnet assembly is shown in detail in FIG. 10. The metallic string 321 is passed through coils 33 and 34 of coil magnet assembly 320. Coils 33 and 34 are comprised of 28-36 gauge copper enameled wire with an inner diameter of three-sixteenths to one-fourth of an inch in the preferred embodiment of the present invention. It will be understood, however, that other types of wire and coil configurations can be utilized without departing from the scope or spirit of the present invention. In the preferred embodiment, a coil having a resistance of approximately 8 ohms has been found to be advantageous. The inner diameter of the coil should be such that the field generated can affect the metallic violin string 321. However, the diameter should not be so small that the metallic string contacts the coil, deadening its motion.

The coils are mounted to the stringed instrument body by epoxy or other suitable means and positive and negative lead lines 35 and 36 are used to electrically couple the coils to the signal output of the drivers.

A magnet 37 is positioned adjacent the metallic string so that the relatively small mass of the string can be moved and made to vibrate. In the preferred embodiment of the present invention, a rare earth magnet comprised of samarium or neodymium is utilized. In the present invention, the magnet 37 is polarized so that the upper surface is north and the lower surface is south. The string is positioned approximately half way between the upper and lower surfaces and a corner of the magnet is closest to the string, approximately one-eighth to one-fourth inch away from the magnet. The opening of the coils are approximately one-eighth inch from the magnet, as well. In an alternate embodiment, only a single coil is utilized.

Also, an electromagnetic finger 326 has been added to stop the associated string making it of a length and tension (tuning) to match or be a harmonic equivalent of a second pitch. Thus, with a single string and finger 326, one can obtain both the original string's pitch and harmonic equivalents, as well as the stopped string's pitch and harmonic equivalents. Thus, with 6 strings, all 12 pitches and harmonic equivalents of the musical scale can be sympathetically reproduced. Another method of obtaining all 12 pitches and their harmonic equivalents is obtained by utilizing multiple electromagnetic stopping fingers 326.

Figure 11:
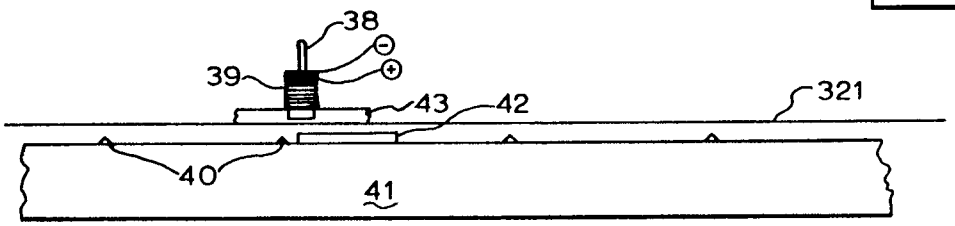
FIG. 11 illustrates the "finger" assembly of FIG. 2.

The electromagnetically activated "fingers" of the present embodiment are illustrated in detail in FIG. 11. The strings of a stringed musical instrument extend over a neck which has a number of frets 40. In normal operation, a user uses his fingers to press a string against a fret to shorten the string to affect the string's tension. The pitch of a stringed instrument is determined by the string's length, mass and tension. By pressing a string against a fret, the length of the string which is excited is changed, changing the pitch.

The present invention may use an electromechanical device to change string length. In the present invention, an electromagnet comprised of a metal core mounted within a coil assembly is positioned over a string. The core coil assembly may be positioned over the string by the use of spacers on either side of the string to support the assembly or it may be suspended with a super structure surrounding the neck of the stringed instrument. In the present invention, spacers 43 disposed on either side of the string 321 are used to support the core coil assembly. The core 38 is disposed within a coil 39. In the preferred embodiment of the present invention, the core 38 is an iron or steel rod with a flattened head member. The coil is such that 5 ohms of resistance are achieved although other resistances may be utilized. A metallic tab 41 is pivotally mounted at pivot point 42 so that the free end of the tab is substantially below the head of the core coil assembly. When a signal is provided to the coil, an electromagnetic field is created, drawing the metallic tab toward the head of the core coil assembly. This catches the string between the head and tab, effectively shortening the length of the string and affecting pitch. The tabs are positioned at the nominal fret positions of a typical stringed instrument. If desired, a tab assembly is provided at each of the fret positions with a corresponding core coil assembly positioned overhead. In this manner, all pitch combinations which can be implemented by human fingers, can be duplicated in addition to others which are not possible because of the length limitations of human fingers.

Alternatively, the core coil assemblies could be disposed within the neck of the stringed instrument, and swinging tabs could be mounted above the string. The tabs could be spring-biased, be in an extended position and drawn down to hold the string when the core coil assembly is activated. The fret itself could be made to be an electromagnet to pull the string against it when activated. Or, an electromechanical hook could be used with a plunger device to pull the string against the neck at desired locations when activated. A coil/magnet assembly could be used to "lock" the string in position or to sympathetically interact with the incoming signal to stop the string.

Figure 3:
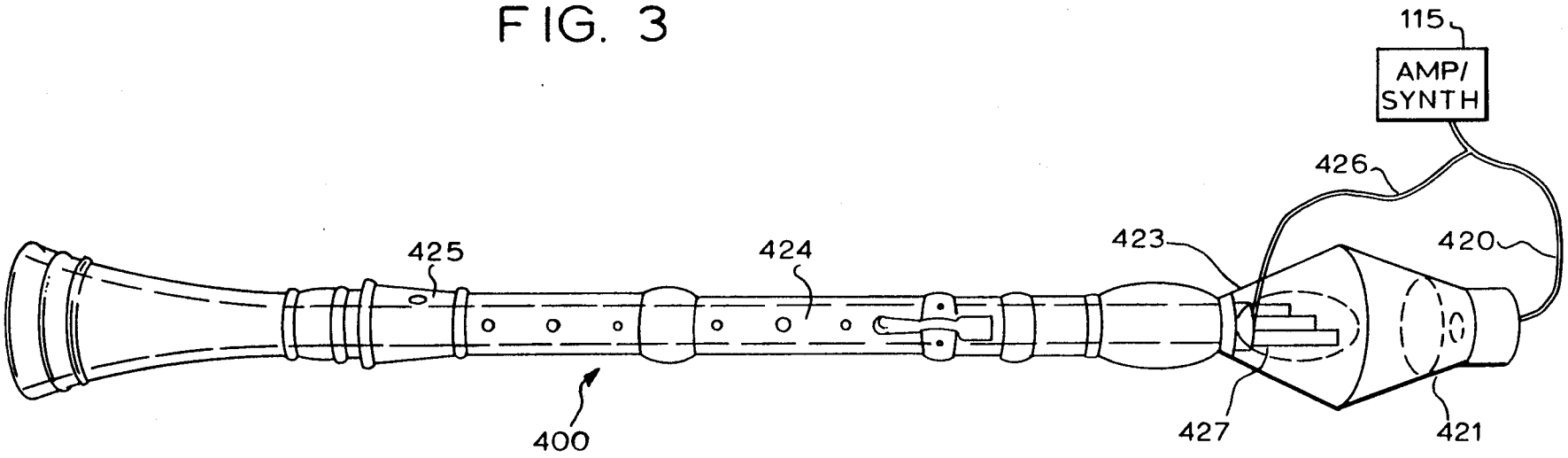
FIGS. 3 and 3(*a*) are illustrations of a typical woodwind or brass instrument transducer assembly.
Figure 3A:
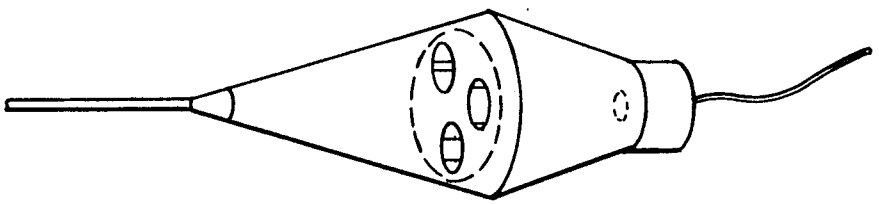

FIGS. 3 and 3(*a*) are illustrations detailing a typical brass or woodwind instrument transducer assembly, in this case a clarinet 400. Air pump 401 forces air through air tunnel 402, mouthpiece 403 and wood body 404. Electromagnet coil 405 and rare earth magnet 408 open and close metallic reed "valve" 406 sympathetically with the incoming voltage configuration 426 from amplifier/mixer 115. Electromagnetic embouchure simulator 407 pushes on metallic reed valve 406 to control embouchure pressure. This vibrates the air column 424 in wood clarinet body 404. Next the vibration is transferred to wood clarinet body 404. This action sets the entire clarinet transducer assembly 400 into a vibration distinctive to the clarinet.

A woodwind instrument can be considered as three essential parts; a reed, a bore and side holes. Air blown into the instrument through the reed sets up vibrations in the column of air within the bore and this vibrating air column produces the sound of the instrument. The frequency at which the air vibrates is determined by the dimensions of the bore. These dimensions are modified in turn by the side holes in both their open and closed positions.

The reed system acts as a valve for replenishing the vibrational energy of the air in the bore by converting a steady flow of compressed air from a player's lungs into a series of puffs at the frequency dictated by the bore. Vibration of the reed opens or shuts the thin slit between the reed and the mouthpiece through which the air is blown into the bore. The frequency of vibration is set by the cyclic changes in the pressure of the vibrating air in the bore.

Figure 12A:
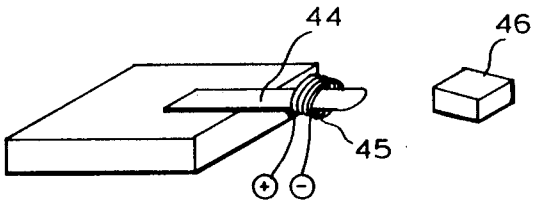
FIG. 12 illustrates the electromagnetically-activated reed assembly in detail.

Thus, an electromagnetically or electromechanically-controlled woodwind instrument requires a supply of air to function properly. The present invention uses an electromagnetically-activated reed assembly in connection with an air supply to produce a controllable and repeatable true woodwind sound. FIG. 12 illustrates the electromagnetically-activated reed assembly of the present invention in detail. The "reed" 44 is a thin metallic strip surrounded by a coil of wire 45. A rare earth magnet 46 is disposed near the reed (approximately one inch away). The electromagnetic coil is stimulated by the sampled or synthesized wind instrument signals and vibrates accordingly. The reed is coupled to a woodwind instrument such as a clarinet and an air supply is provided to pass over the reed and into the bore of the woodwind.

In the present invention, different pitches can be achieved by changing the pitch of the sampled signal used to stimulate the reed. That is, the side holes are not required to change the pitch of the woodwind instrument. Control of the reed's vibrations may be achieved with an electromechanical control the vibration of the reed much as users month would do on a traditional woodwind. The embouchure simulator is moved adjacent to or abutting the reed to limit vibration and comprises a small rod or plunger "embouchure pressure attachment."

Figure 4:
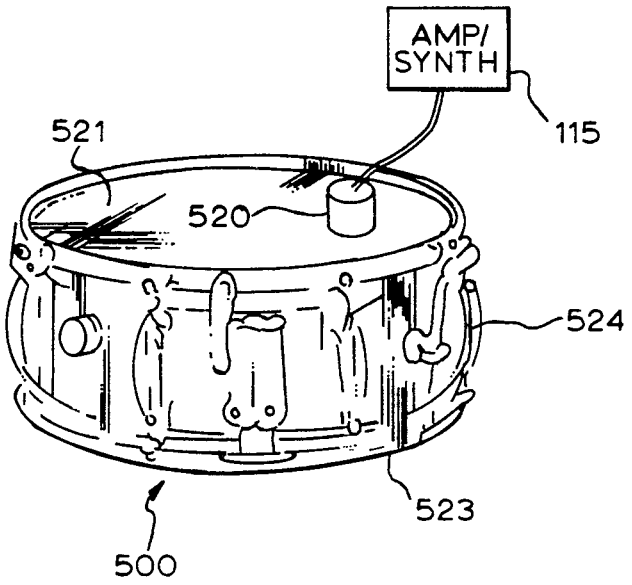
FIG. 4 is an illustration of a typical percussion instrument transducer assembly.

FIG. 4 is an illustration detailing a typical percussion instrument transducer assembly, in this case a snare drum 500. The drum 500 consists of a hollow cylinder body 524 and membrane/diaphragm 521. In the example shown, the drum body 524 is comprised of metal such as steel or aluminum. However, drums of wood or other material can be utilized as well. Typically, the drum body 524 is open on one end with the other end covered with a membrane/diaphragm 521. The membrane 521 is stretched tightly across one end of the drum body 524 so that when the membrane is excited, the air column in the drum body is vibrated, producing a drum sound.

Coil/magnet assembly 520 energizes membrane vibrator diaphragm 521 sympathetically with the incoming voltage configuration from amplifier/mixer 115. This vibrates membrane 521 as well as air column 523 in metallic drum body 524, said vibration being transferred to hollow metallic snare drum body 524. This action sets the entire snare drum transducer assembly 500 into a vibration distinctive to the snare drum.

FIGS. 5*a*–5*c* illustrate several possible embodiments of rack-mountable acoustic instrument transducers with built-in microphone and pickup assemblies. The present invention may be used in a variety of locations of varying degrees of acoustic quality. Therefore, it is desired to configure the present invention to provide consistent environmental performance. The rack-mountable system of FIGS. 5*a*–5*c* is one solution to this problem. The rack system encloses each electronically-stimulated musical instrument in a box-like container. This allows stacking of a number of instruments, saving on space. Further, the box containers provide a consistent integral environment for each instrument, regardless of the external environment in which its used.

FIG. 5*a* illustrates a possible configuration for a stringed instrument such as a guitar, violin, bass, etc. In this case, since rack box 600 constitutes its own room reverberation environment, the sound emitted by the instrument transducer from sound holes 601 is picked up by microphone 602 and delivered to reverberation system 603 where the desired room reverberation is added. Instrument transducer sound can also be picked up at the condenser microphone pickup 604 and be sent to the reverberation system 603 where the desired room reverberation is added. FIG. 5*b* illustrates the same principal for a woodwind or brass instrument, while FIG. 5*c* illustrates the same principal for percussion instruments.

Figure 6:
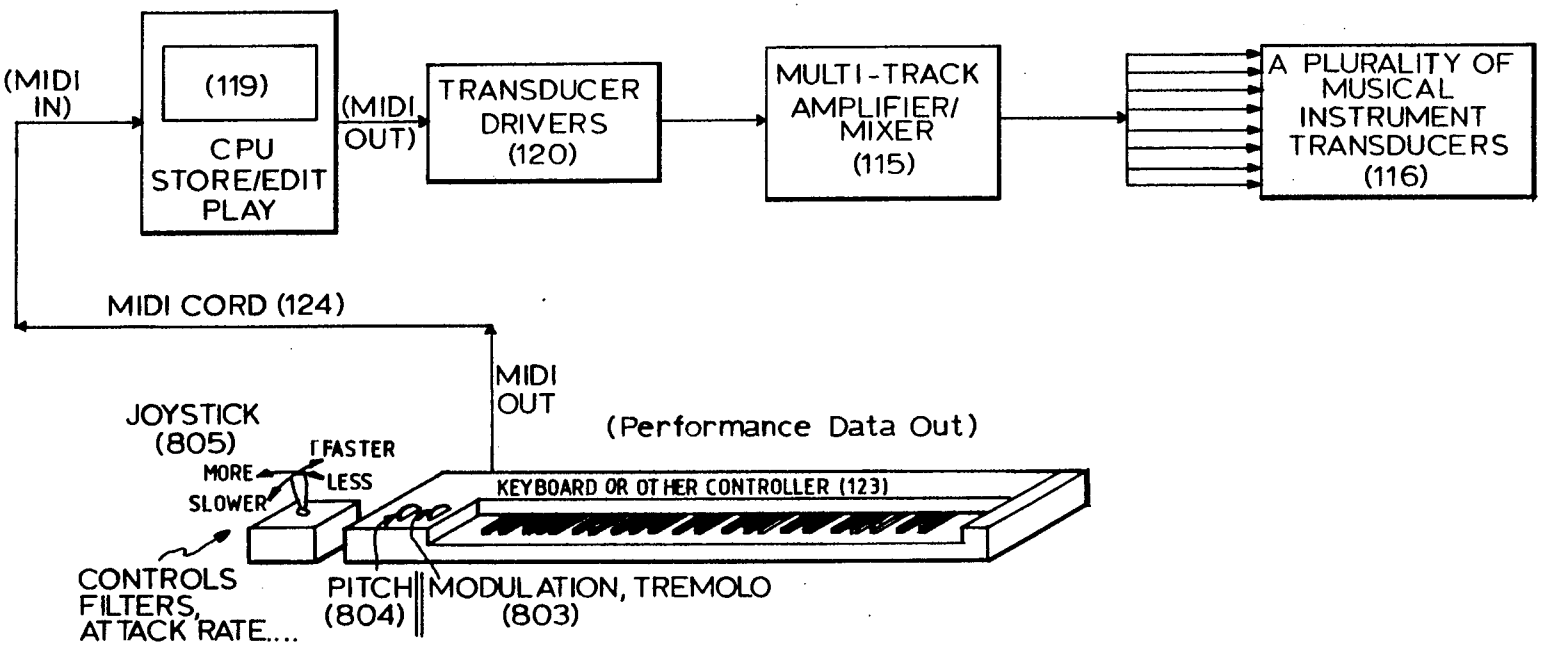
FIG. 6 is a block diagram for of the system as a composition/performance tool.

FIG. 6 is a block diagram of the system in FIG. 1 as a composition/performance tool. Performance on a keyboard or other controller 123 can be directly routed to CPU 119 using a MIDI cord 124. In this environment, every aspect of the musical performance, including note pitch, rhythmic placement, duration, velocity, attack, after-touch, modulation, pitch bend, filters and other synthesizer and sampler parameters can be controlled, recorded, edited and reproduced digitally in the CPU 119 and played through the transducer drivers 120, multi-track amplifier/mixer 115, and instrument transducers 116 for faithful reproduction of acoustic or acoustic hybrid instrument sounds. In this way, a musician can play any acoustic or acoustic hybrid instrument by simply making a track assignment in CPU 119 to any one of a plurality of acoustic or acoustic hybrid instruments 116.

The present invention uses a sample of a violin sound (the voltage pattern of a violin sound) to vibrate a metallic string like a violin string. A controller, such as a keyboard or a CPU, is used so that the sound can be modified. The string, when excited by a violin sound, "mirrors" the sound, that is, sounds the same as the sound that is input. Therefore, if only a single sample were used to excite the string, the string would produce the same sound every time. The present invention can be used to modify the tremolo, pitch bend, modulation, attack, decay, etc., of the sound so that performances can be created on the electronically-controlled acoustic instruments. Generally, MIDI controllers have wheel-like or joystick-like devices to control the synthesizer's charcteristics. A joystick 805 can be utilized to translate acoustic violin actions and sounds into options such as strike hard with a bow, tremolo, play lightly, a fast bow, slow bow, muted, etc. It is well known how to control a joystick to produce different output voltages depending on the position of the joystick. The present invention utilizes this characteristic to provide different signal strengths to provide different characteristics of the modified and electronically-controlled acoustic instruments. The keyboard of a controller itself is utilized to change the pitch of a sampled sound so that different pitches can be generated on the acoustic instruments.

Figure 7:
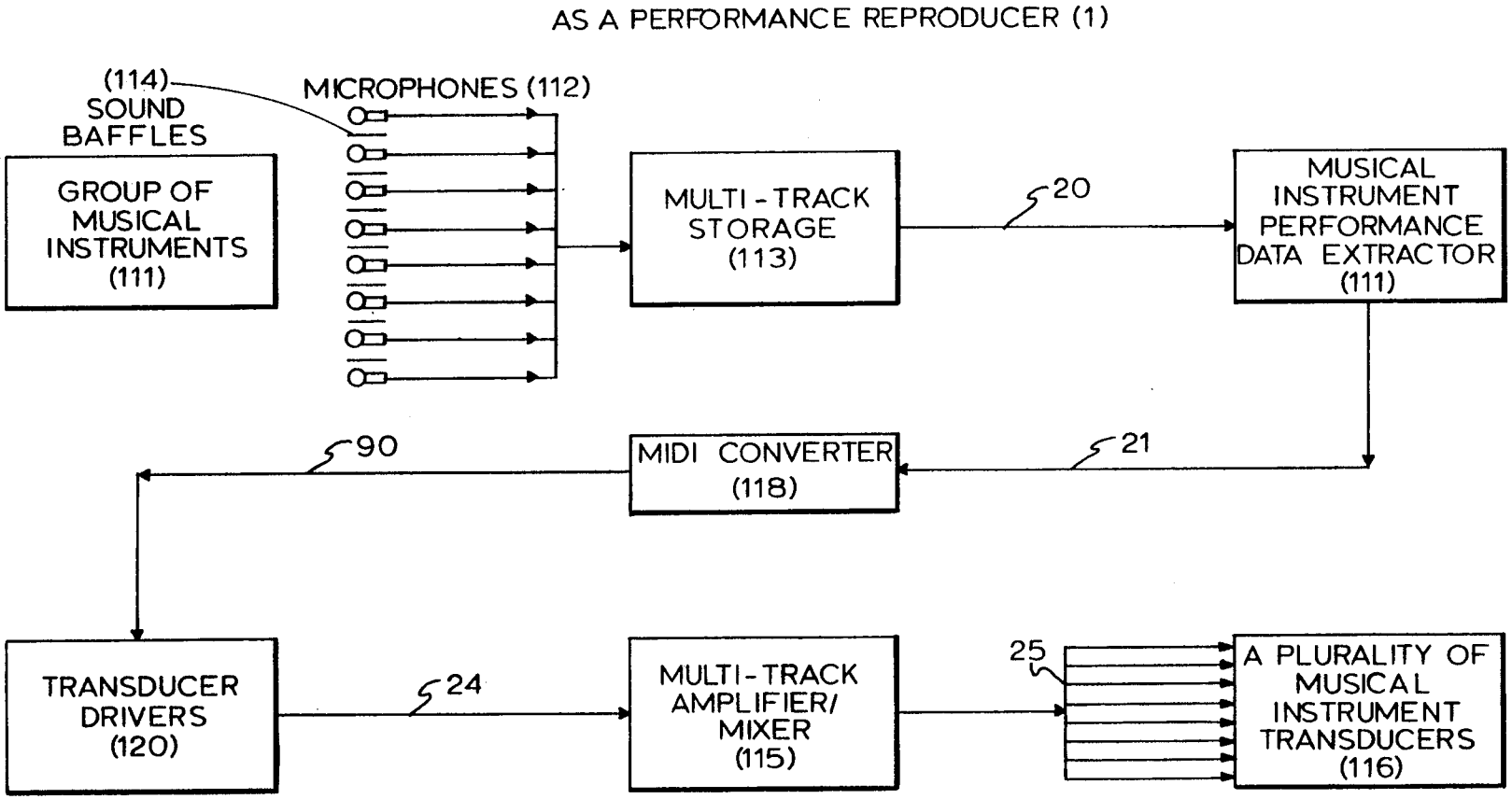
FIG. 7 is a block diagram of the system as a controlled multi-track performance reproducer.

FIG. 7 is a block diagram of the system functioning as a controlled multi-track performance reproducer. The sound of a group of musical instruments 111, (for example, an orchestra or a rock group) is detected by a plurality of carefully placed microphones 112 (one microphone each for electric guitar, violin, bass, trumpet, soprano saxophone, snare drum and cymbal for example). Each instrument is recorded onto a separate channel of multi-track storage system 113. Sound quality is retained by a combination of careful microphone placement, sound baffle 114 placement, and room separation if necessary. Strict group isolation is not required; leakage in this method is faithful to "real-world" acoustic principals.

From multi-track storage system 113, the recorded signal is sent via line 20 through instrument pitch/frequency performance data extractor 117, sent to converter 118 via line 21, converted to MIDI data, and sent to transducer driver 120 via line 22. From the multi-track amplifier 115 all sounds are directed via lines 25 to instrument transducers 116 for faithful reproduction of acoustic instrument sounds or acoustic hybrid sounds.

Figure 8:
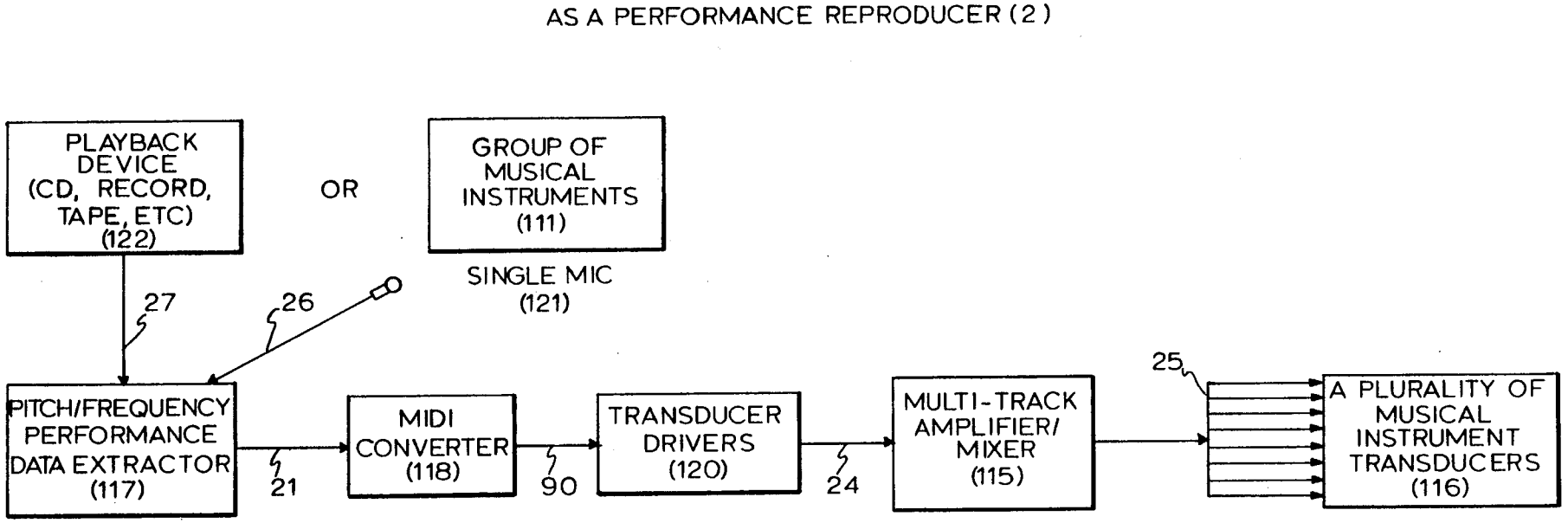
FIG. 8 is a block diagram of the system as a live or recorded performance pitch/frequency and performance data extraction system and reproducer.

FIG. 8 is a block diagram of the system in FIG. 1, configured as a live or recorded performance pitch/frequency and performance data extraction system and reproducer. The group of musical instruments 111 with a single microphone 121, or a playback device 122 can be patched directly to pitch/frequency performance data extractor 117 via line 27 or 26, then the MIDI converter 118 via line 21, and on to transducer drivers 120 via line 22 where the extracted signals are digitally reassembled, then via line 24 to multi-track amplifier/-mixer 115, and via lines 25 to instrument transducers 116 for faithful reproduction of the acoustic instrument or acoustic hybrid sounds. In this system, automatic tracking/extraction device 117 will determine how instrument transducers 116 will sound.

The performance data extractor block 117 is used to extract pitch and performance data from input waveform signals such as produced as a result of a live musical performance. A number of pitch data extractors are described in the prior art such as in U.S. Pat. Nos. 4,841,827; 4,690,026; 4,688,464; 4,627,323; 4,479,416; and 4,432,096. Any of the devices described in those patents or any other suitable device may be used to remove pitch and frequency performance data from the sound signals produced from a live or recorded performance. As noted, a plurality of microphones 112 can be used to separate the performance into a series of "tracks" which can be extracted individually. Alternatively, the data extractor receives input from a single microphone or recording and extracts performance information.

Thus, the present invention has two methods for providing signals for use in exciting the secondary transducers of the controlled acoustic and acoustic hybrid musical instruments. In one method, a live or recorded performance is used to provide input to a pitch frequency performance data extractor where individual instrument sounds are extracted and used to stimulate corresponding controlled acoustic or acoustic hybrid instruments. In another method, a keyboard controller is used to create a sound or sound signal which is then provided to the secondary transducers. In either case, the sound source is converted to MIDI format and provided to multi-track synthesizer/sampler transducer drivers 120. The synthesizer/sampler transducer drivers 120 may be any commercially available model such as an Akai S900 or a Yamaha TX802. The synthesizer/-sampler transducer drivers block 120 utilizes the MIDI input to create a synthesized or sampled sound which is provided to an amplifier mixer 115 for amplification. This amplified sound signal is used to stimulate the secondary transducers which in turn stimulate the primary transducers of the controlled acoustic instruments to produce sound.

Regardless of the sound source, the MIDI signals can be manipulated or edited by the CPU 119 although this is not required. The MIDI signals can be provided directly to the synthesizer/sampler block 120 if desired.

Figure 9:
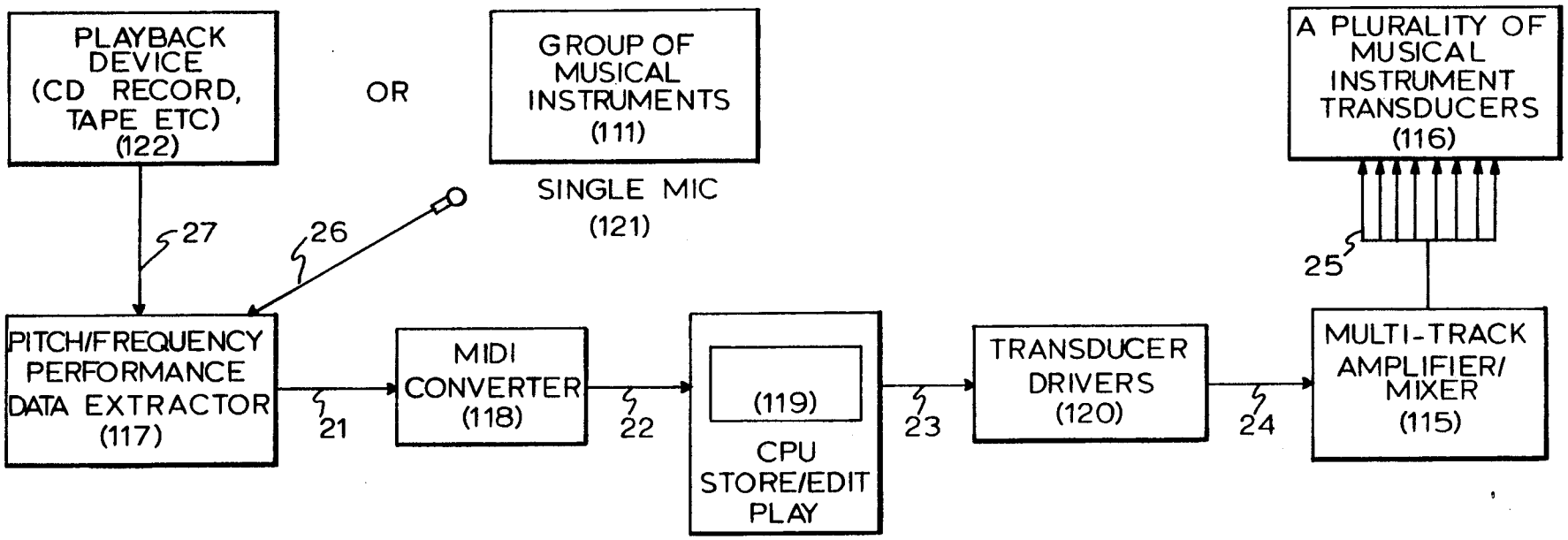
FIG. 9 is a block diagram of the system as a live or recorded performance transcribing, editing and reproduction system.

FIG. 9 is a block diagram of the system of FIG. 1 functioning as a live or recorded performance transcribing, editing and reproduction system. A group of musical instruments 111 with a single microphone 121, or playback device 122 can be patched directly via lines 26 or 27 to pitch/frequency performance data extractor 117, then to MIDI converter 118 via line 21, then into CPU 119 via line 22 where digital performance information in CPU 119 can be stored, edited and played via line 23 through transducer drivers 120, where the extracted signals are digitally reassembled, then via line 24 to multi-track amplifier/mixer 115, and via lines 25 to instrument transducers 116 for faithful reproduction of acoustic instrument or acoustic hybrid sounds.

The present invention allows acoustic performance reproduction of the following source performances; acoustic, acoustic and electronic or electronic. The present invention also allows the acoustic/electronic (i.e., synthesizer and sampler) reproduction of music from the following sources; acoustic, acoustic and electronic, and electronic. A combination or mix of electronically and mechanical stimulated acoustic musical instruments and electronic musical instruments is referred to as an "acoustic/hybrid" musical instrument.

Thus, a method and apparatus for stimulation of acoustic musical instruments has been described.

I claim:

1. An apparatus for producing sound from an acoustic instrument having a magnetically excitable primary transducer comprising:

a storage means for storing sound outputs;

converting means coupled to said storage means for converting said sound output to a first signal;

driving means coupled to said first signal, said driving means providing a driver output signal;

a secondary transducer coupled to said driver output signal, said secondary transducer electromagnetically initiating vibration in said magnetically excitable primary transducer to create sound from said acoustic instrument.

2. The apparatus of claim 1 wherein said sound output is generated by an acoustic instrument.

3. The apparatus of claim 1 wherein said converting means comprises a MIDI converter.

4. The apparatus of claim 3 wherein said first signal comprises a MIDI output signal.

5. The apparatus of claim 1 wherein said driving means comprises a synthesizer/sampler.

6. The apparatus of claim 1 wherein said acoustic instrument comprises a stringed instrument.

7. The apparatus of claim 6 wherein said magnetically excitable primary transducer consists of any strings of said musical instrument.

8. The apparatus of claim 7 wherein said secondary transducer comprises an electromagnetic coil for exciting said strings.

9. The apparatus of claim 1 further including a processing means coupled to said first signal for storing, editing and replaying said first signal, said processing means providing output to said driving means.

10. A method for producing sound from an acoustic instrument having a magnetically excitable primary transducer comprising the steps of:

converting a sound source to an electronic signal;

providing said electronic signal to a secondary transducer positioned adjacent to said magnetically excitable primary transducer;

stimulating said secondary transducer so as to electromagnetically initiate vibration in said magnetically excitable primary transducer, producing sound from said acoustic instrument.

11. The method of claim 10 wherein said acoustic instrument is a stringed instrument.

12. The method of claim 11 wherein a string of said stringed acoustic instruments has a length and tension which is a harmonic equivalent of the electronic signal.

13. An apparatus for producing sound from an acoustic instrument having a magnetically excitable primary transducer for producing vibrations in a body of air comprising:

sound producing means for producing a sound output;

converting means coupled to said producing means for converting said sound output to a first signal;

driving means coupled to said first signal, said driving means for providing a driver output signal;

a secondary transducer coupled to said driver output signal, said secondary transducer for electromagnetically initiating vibration in said magnetically excitable primary transducer to create sound from said acoustic instrument.

14. The apparatus of claim 13 wherein said sound producing means comprises a MIDI keyboard.

15. The apparatus of claim 13 wherein said sound producing means comprises a recording of a live musical performance.

16. The apparatus of claim 14 wherein said first signal comprises a MIDI output signal.

17. The apparatus of claim 13 wherein said driving means comprises a synthesizer/sampler.

18. The apparatus of claim 13 further including a processing means coupled to said first signal and said driving means, said processing means for manipulating said first signal.

19. The apparatus of claim 13 wherein said primary acoustic instrument comprises a stringed instrument.

20. The apparatus of claim 13 wherein said acoustic instrument comprises a woodwind.

21. The apparatus of claim 13 wherein said acoustic instrument comprises a percussion instrument.

22. The apparatus of claim 13 wherein said acoustic instrument comprises a brass instrument.

* * * * *